United States Patent [19]

Verseef

[11] Patent Number: 5,025,577

[45] **Date of Patent: * Jun. 25, 1991**

[54] ADJUSTABLE ONE-WAY TRIP EDGE SNOW PLOW

[75] Inventor: Jan H. Verseef, Clayton, N.Y.

[73] Assignee: Frink America, Inc., Clayton, N.Y.

[ * ] Notice: The portion of the term of this patent subsequent to Jun. 13, 2006 has been disclaimed.

[21] Appl. No.: 389,343

[22] Filed: Aug. 3, 1989

[51] Int. Cl.[5] ..... E01H 5/06

[52] U.S. Cl. ..... 37/280; 37/266; 37/279

[58] Field of Search ..... 37/232, 233, 266, 279, 37/234, 283, 280, 281

[56] References Cited

U.S. PATENT DOCUMENTS

| | | | |
|---|---|---|---|
| 3,604,131 | 9/1971 | Bogenschutz et al. | 37/232 |
| 3,808,714 | 5/1974 | Reissinger et al. | 37/233 |
| 4,019,587 | 4/1977 | Meisel Jr. | 37/279 X |
| 4,216,833 | 8/1980 | Fezatt et al. | 37/283 X |
| 4,259,794 | 4/1981 | Rath | 37/232 X |
| 4,552,226 | 11/1985 | Platter | 37/279 X |
| 4,635,387 | 1/1987 | Häring | 37/232 X |
| 4,707,936 | 11/1987 | Steinhoff | 37/266 X |
| 4,794,710 | 1/1989 | Häring | 37/232 |
| 4,803,790 | 2/1989 | Ciula | 37/266 |
| 4,837,951 | 6/1989 | Verseef | 37/281 X |

FOREIGN PATENT DOCUMENTS

| | | | |
|---|---|---|---|
| 46436 | 4/1976 | Japan | 37/233 |
| 17543 | 4/1981 | Japan | 37/233 |

*Primary Examiner*—Dennis L. Taylor
*Assistant Examiner*—J. Russell McBee
*Attorney, Agent, or Firm*—Wall and Roehrig

[57] ABSTRACT

A moldboard assembly having a flexible moldboard sheet joined along its bottom edge to a scraper blade unit so that material passing over the blade is directed into contact with the sheet. One top corner of the sheet is fixed to a side plate and an adjusting arm is secured to the other top corner of the sheet and is independently positioned to contour the sheet to any desired shape whereby the flow of material through the assembly can be accurately controlled.

6 Claims, 5 Drawing Sheets

ADJUSTABLE ONE-WAY TRIP EDGE SNOW PLOW

BACKGROUND OF THE INVENTION

This invention relates to a moldboard assembly having a flexible moldboard sheet that is adjustable at the discharge end to change the contour of the moldboard to control the flow of material through the moldboard, and the discharge of material therefrom.

Most conventional moldboards are formed from metal into a desired shape depending upon its intended use. In some cases, the moldboard is involuted to provide a flared discharge at one end for casting snow to one side of the propelling vehicle. A lightweight plastic moldboard has been developed by the present assignee which, unlike a steel moldboard, does not have to be laboriously bent to a desired curvature during manufacture. The plastic moldboard is simply molded or otherwise formed into a sheet of desired dimensions and the sheet is then mounted upon a movable support frame. The moldboard can then be contoured to the desired shape by adjusting the movable frame. This type of reversible moldboard is disclosed in U.S. Pat. No. 4,837,951 which issued June 13, 1989.

The above described moldboard, readily formed at both ends to discharge snow to the left or the right as desired, has been a great improvement over previously available moldboards and plows, and has allowed much greater flexibility in the plowing operation and much faster conversion from left hand to right hand discharge, as required by the particular wind conditions and/or space availability for discharge of the plowed snow. While this configuration has been very favorably received for large operations involving many different types of snow conditions and discharge requirements, it has been found that the apparatus can be somewhat expensive and complicated for simpler plowing requirements.

OBJECTS AND SUMMARY OF THE INVENTION

Accordingly, it is an object of the present invention to provide a simplified, less expensive one-way discharge adjustable moldboard plow.

It is another object of the present invention to provide a moldboard assembly for a snowplow, the contour of which can be selectively changed at one end to control the flow of snow through the assembly.

It is a further object of the present invention to provide a standard one-way discharge snow plow in which the contour of the discharge end can be selectively changed to control the flow of the snow therethrough and the discharge therefrom.

Another object of the present invention is to reduce the amount of components required to provide an adjustable moldboard assembly and to reduce the cost of providing flexibility in a standard one-way discharge plow.

These and other objects of the present invention are attained by securing the bottom edge of a flexible moldboard sheet to the top edge of a scraper blade unit, fixing one top corner of the sheet to a side frame member and attaching an adjustment arm to the other top corner of the sheet and independently positioning said arm to contour the discharge side of the sheet to a desired shape.

BRIEF DESCRIPTION OF THE DRAWING

For a better understanding of these and other objects of the present invention, reference shall be made to the following detailed description of the invention which is to be read in association with the accompanying drawings, wherein.

DETAILED DESCRIPTION OF THE INVENTION

Figure 1:
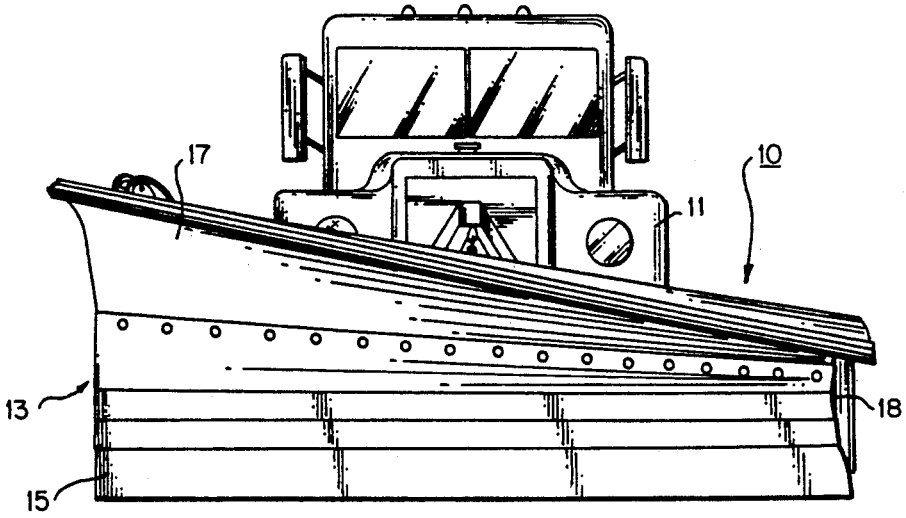
FIG. 1 is a front view of a moldboard assembly embodying the teachings of the present invention showing the moldboard contoured to discharge snow to the right side of a vehicle to which the moldboard assembly is attached.
Figure 1A:
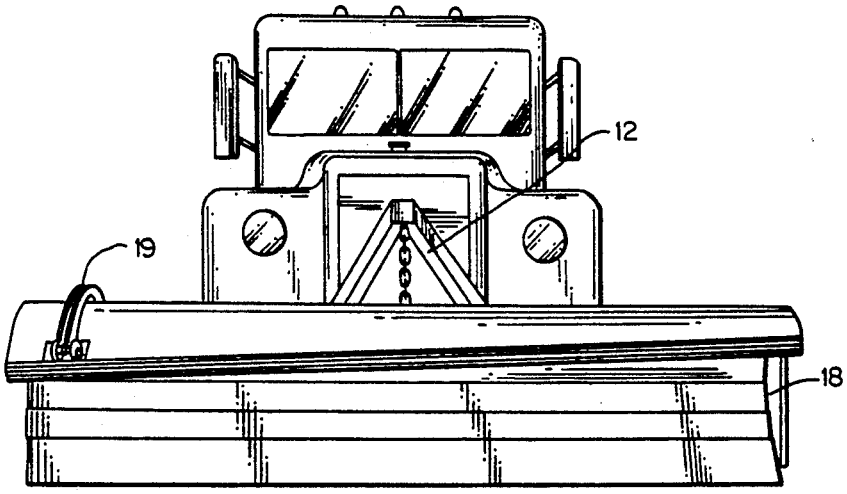
FIG. 1*a* is a view similar to FIG. 1 showing the moldboard contoured to discharge the snow in a lower directed fashion.
Figure 2:
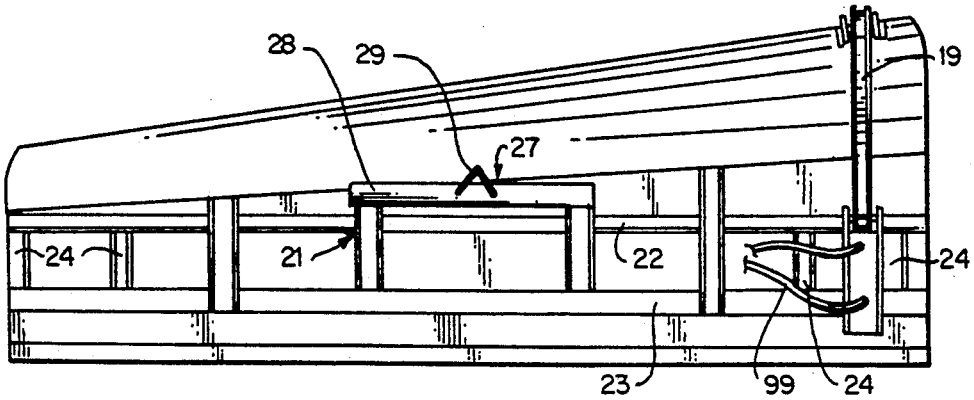
FIG. 2 is a rear elevation of the present moldboard assembly showing the support frame and adjusting arm of the assembly.
Figure 3:
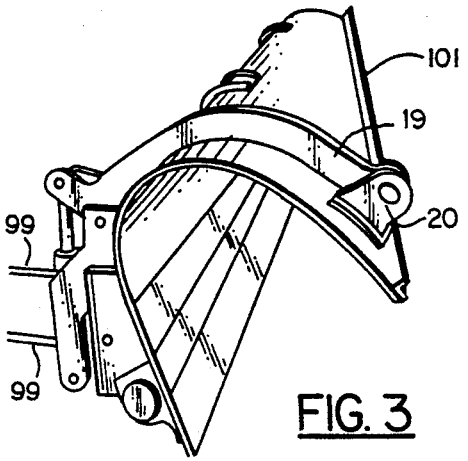
FIG. 3 is a perspective end view showing the moldboard of the present invention.

Referring now to the drawings, and in particular to FIGS. 1–3, there is shown a moldboard assembly, generally referenced 10, that is attached to the front of a truck 11 by means of a combination push frame and lifting conventional adjusting arm mechanism 12 of any suitable design. The moldboard assembly includes a trip blade unit 13 containing an elongated scraper blade 15, a flexible moldboard sheet 17 a side frame member 18 and adjusting arm 19 that is attached to the back of the moldboard sheet at the top left hand corner of FIG. 1 by ball and socket universal joint connector 20. As will be explained in greater detail below, the shape of the flexible moldboard sheet can be varied through the use of the adjusting arm to control the movement of the snow through the moldboard and thus permit an operator to precisely control the delivery of snow to the side of the vehicle without dismounting from the cab.

The flexible moldboard 17 is fabricated from a single sheet of any suitable high strength flexible material that is abrasion resistant and has high impact resistance. Preferably the moldboard sheet is constructed of any one of many plastics exhibiting these characteristics or blends thereof. Because snow will not stick to most plastics, the flow of snow through a plastic moldboard will be relatively constant for any configuration. The operator therefore can finely tune the moldboard much like an adjustable fluid nozzle to meet different snow conditions from wet and heavy to dry and light, and/or to place the snow with refined accuracy into desired disposal areas.

As further illustrated in FIG. 2, the moldboard assembly includes a rigid main support frame generally referenced 21 that is located behind the trip blade assembly and the previously noted flexible moldboard sheet. The frame contains a pair of spaced horizontal members 22 and 23 that are joined by means of vertical aligned end ribs 24—24. A lifting bracket 27 is welded to the frame so that it is centrally located therein. The bracket has an upper horizontally disposed cross member 28 containing a link 29 for attaching the moldboard assembly to the pusher frame and lifting assembly mounted upon the front of the vehicle 11 (FIG. 1). The right hand end in FIG. 1 of the frame includes side plate member 18 to which the moldboard is fixed at its upper corner.

Figure 4:
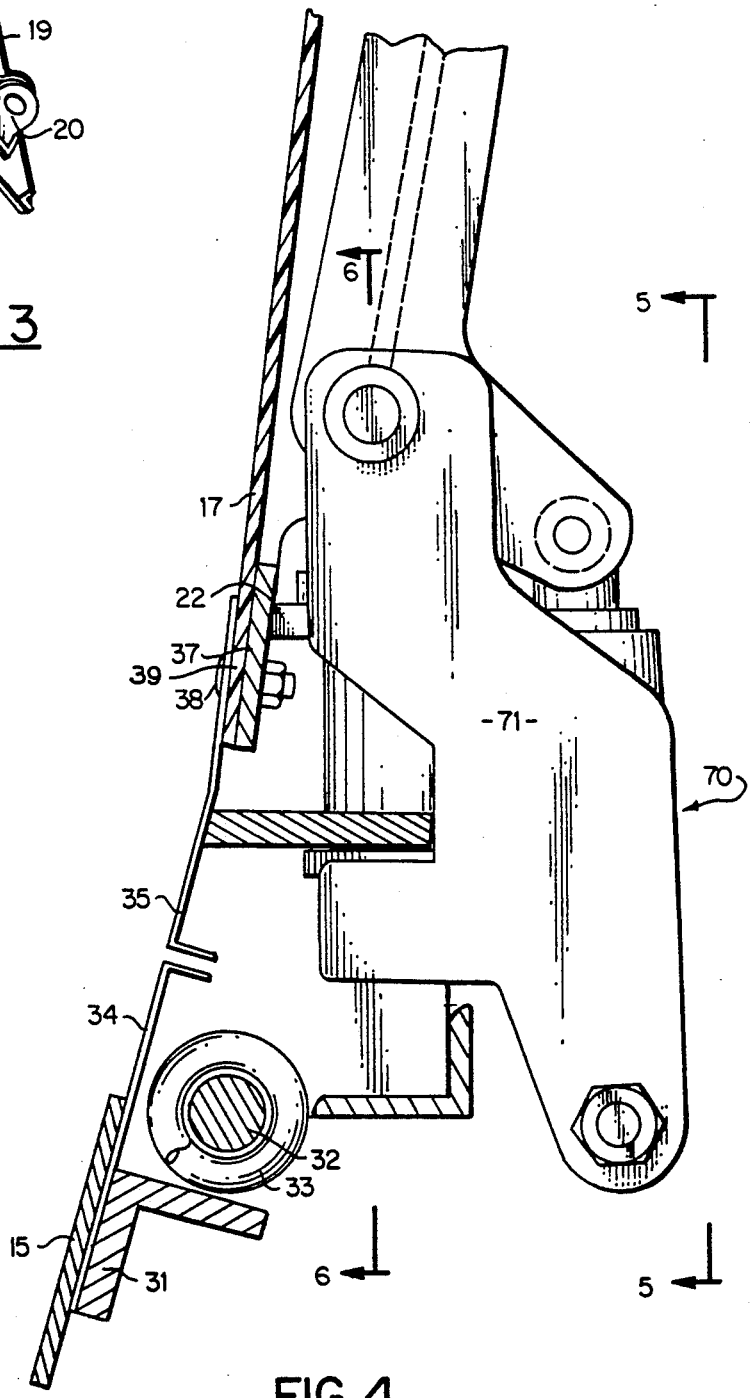
FIG. 4 is an enlarged partial side elevation showing the present moldboard assembly and the adjusting arm mounting in the support frame of the assembly.
Figure 5:
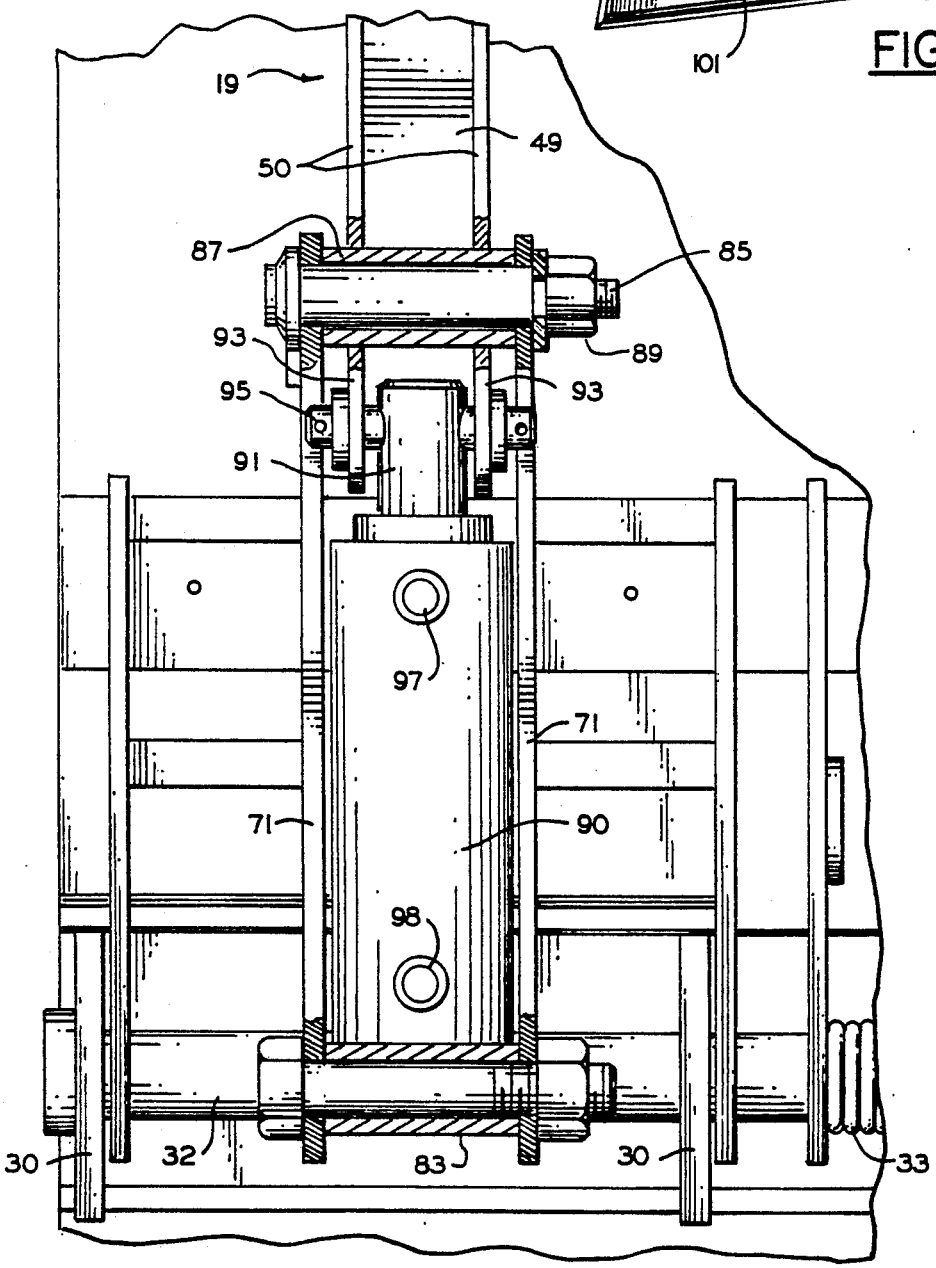
FIG. 5 is a partial sectional view taken along lines 5—5 of FIG. 4.

As best illustrated in FIG. 4, the scraper blade 15 is secured to horizontally disposed angle 31 which is rotatably supported upon a series of coaxially aligned shafts 32. The shafts, in turn, are supported on the main support frame within mounting lugs 30 (FIG. 5). A series of torsion springs 33 are wound about the shaft and are arranged to act against the angle to bias the scraper blade in the normal plowing position as shown. In the event the blade moves against a rigid obstruction as it is being driven forward by the truck, the blade will turn under the shaft 32 to permit the object to move thereunder. Once the object has passed under the assembly, the springs will quickly return the blade to a normal operative position.

A deflector plate 34 is sandwiched between the blade 15 and angle 31. The plate extends upwardly beyond the top of the blade and is arranged to coact with a guide plate 35 to direct snow moving over the blade upwardly into contact with the flexible moldboard sheet 17. A backing member 37 is secured to upper frame member 22 as by welding and the upper section of the guide plate 35 is securely bolted along its length to the backing plate by means of uniformly spaced carriage bolts 38. The bottom skirt 39 of the flexible moldboard sheet is clamped between the guide plate 35 and the backing member 37 and is securely held in place by the bolts which are arranged to pass through holes provided in the sheet. The entire lower edge of the rectangular moldboard sheet is thus held immobile in the top of the trip blade unit. The upper part of the flexible sheet is free to move at one end so that it can be selectively shaped to most efficiently handle snow for prevailing weather and road conditions.

Figure 9:
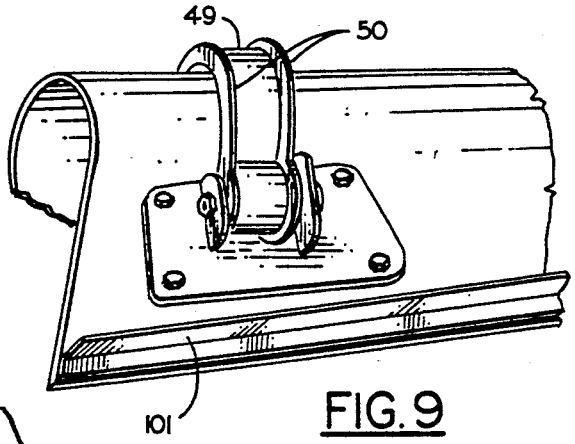
FIG. 9 is a perspective view of the universal joint shown in FIGS. 7 and 8.
Figure 8:
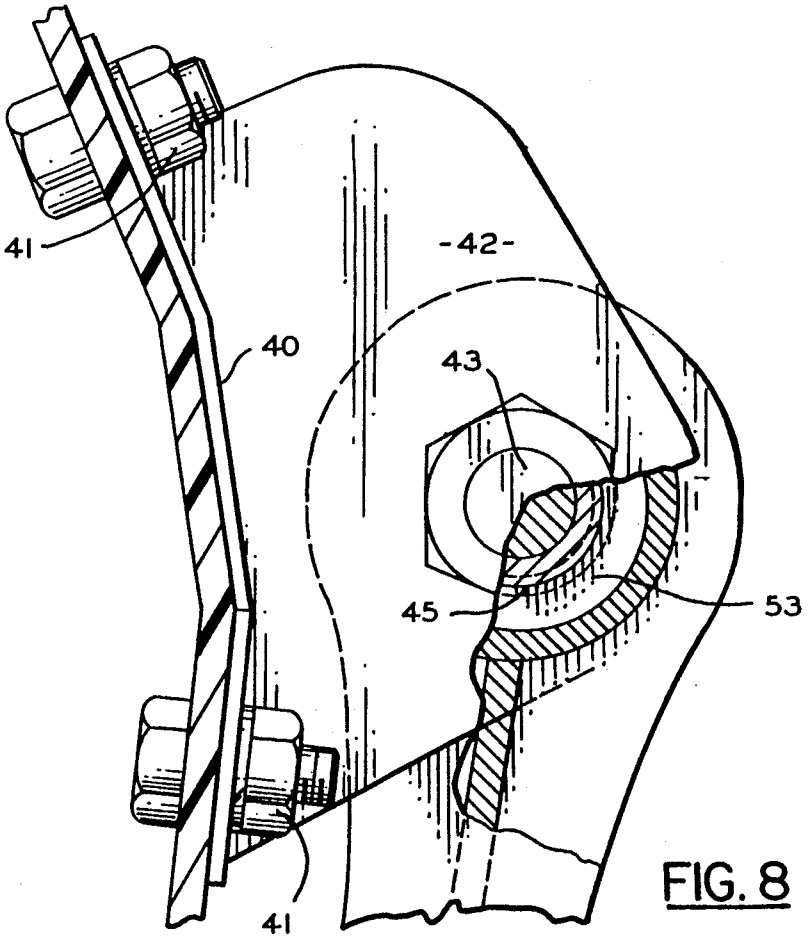
FIG. 8 is a side elevation of the universal joint shown in FIG. 7.
Figure 7:
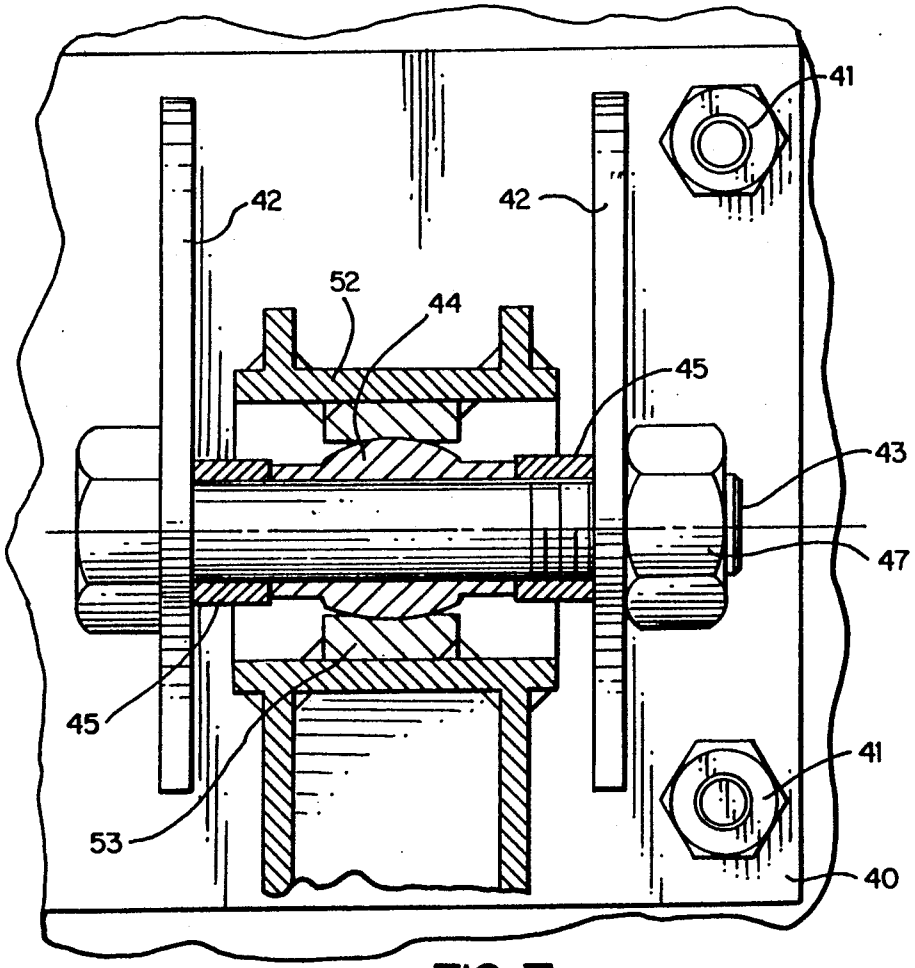
FIG. 7 is an enlarged plan view in partial section showing a universal joint for securing an actuator arm to the top corner of the moldboard sheet.

The upper section of the flexible moldboard sheet is connected at one rear top corner to the distal end of movable adjusting arm 19 by means of universal joint connector 20. FIGS. 7-9 show in greater detail the construction of one of the connectors. A base plate 40 is bolted to the back of the sheet at the corner by bolts 41—41. A pair of raised parallel tabs 42—42 depend upwardly from the base plate and a bolt 43 is passed through the tabs and is secured in place by locknut 47. A cylindrical ball segment 44 is mounted on the stud portion of the bolt and is centered between the tabs by means of two centering bushings 45—45.

The adjusting arm 19 includes a web 49 and a pair of opposed side walls 50—50 (FIG. 9). A cylindrical sleeve 52 is passed through holes provided in the sidewalls 50—50 of the adjusting arm and is welded to the sidewalls as shown. A ball seat 53 is affixed to the inner wall of the tube and mates in assembly with the ball segment to provide a universal joint between the arm and the top corner of the sheet.

Figure 6:
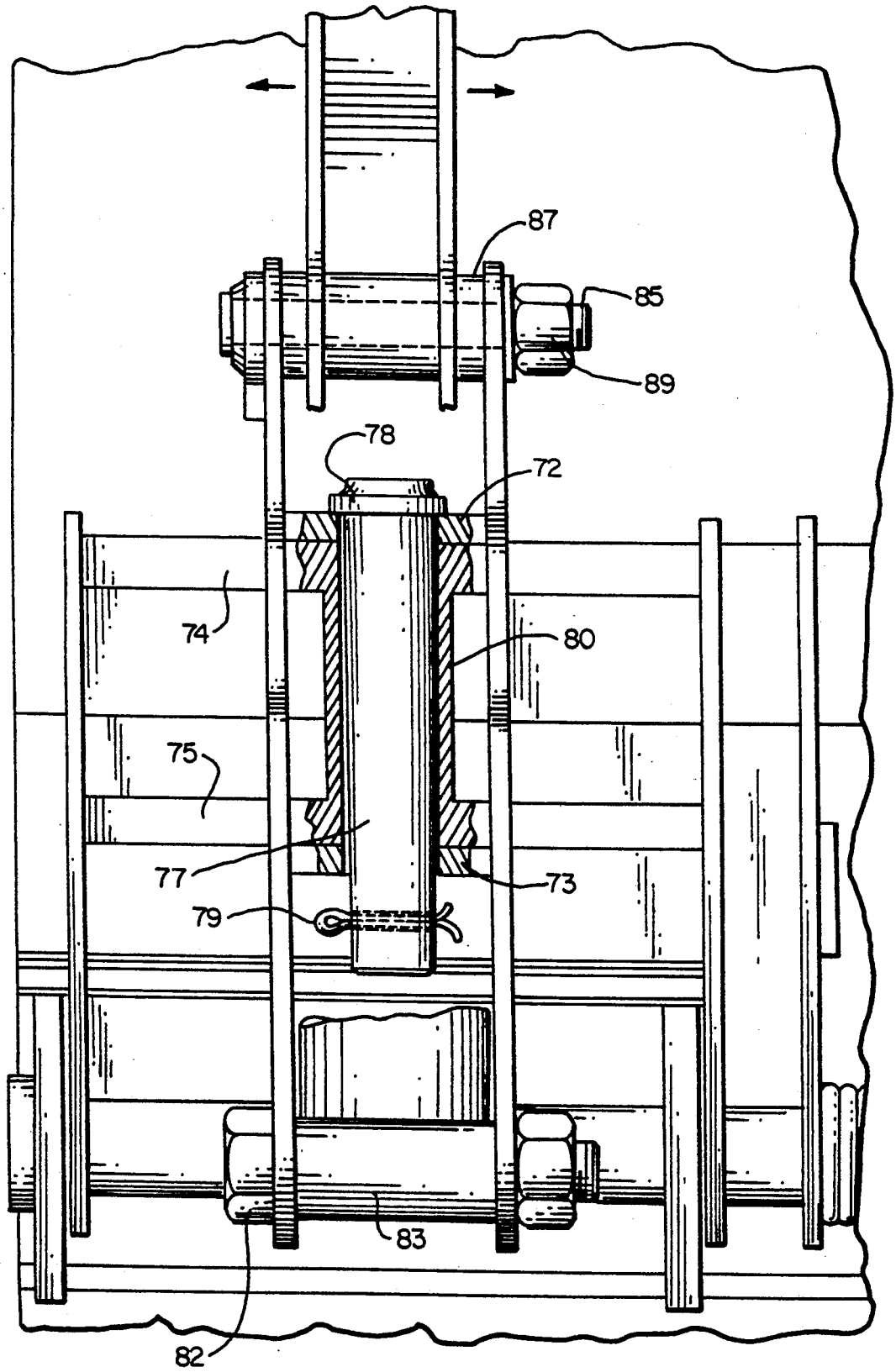
FIG. 6 is a view taken along line 6—6 of FIG. 4.

Referring once again to FIGS. 4, 5 and 6, the proximal or lower end of the adjusting arm is contained within a movable bracket generally depicted at 70. The bracket includes a pair of vertical sidewalls 71—71 that are held in spaced relationship by a horizontal webs 72 and 73. The webs, in assembly, are superimposed over an upper horizontal flange 74 and a lower horizontal flange 75 which are securely welded to the main frame. A pivot pin 77 having an expanded head 78 is passed downwardly through the superimposed members and is retained in assembly by a cotter pin 79. A vertical tube 80 is mounted between the flanges which surrounds the body of the pivot pin 77. A tie bolt 82, which is arranged to pass through both horizontal sleeve 83 and the bottom section of the bracket, is bolted in place to hold the lower portion of the sidewalls in spaced apart alignment.

Accordingly, the bracket is secured to the main frame of the moldboard assembly by vertical pivot pin 77 which permits the bracket to swing in a horizontal plane about the pin.

The proximal or lower end of the adjusting arm 19 passes between the upper sections of the bracket sidewalls and is secured therebetween by a threaded horizontally disposed hinge pin 85. A spacer sleeve 87 passes through the sidewalls 50—50 of arm 19 and seats against the opposing sidewalls of the bracket. The threaded end of the hinge pin is secured in place by means of a lock nut 89. Adjusting arm 19 is thus adapted to pivot in either a horizontal or a vertical plane. As will become apparent from the disclosure below, this freedom to move in two planes allows the adjusting arm to independently position the top corner of the moldboard sheet in an infinite number of positions within the movable range of the arm. This results in bending the moldboard into a scroll-like configuration to smoothly control the flow of snow therethrough.

As shown in FIG. 5, a double acting hydraulic cylinder 90 is pivotally mounted in the lower part of bracket 70 upon sleeve 83. A reciprocating rod 91 extends from the top of the cylinder 90 and is connected between ears 93—93 carried in the lower part of the movable arm 19 by means of a horizontally disposed pin 95. By extending or retracting the rod 91, the arm can be turned about horizontal hinge pin 85 thus permitting the attached top corner of the moldboard sheet to be selectively positioned. A pair of ports 97 and 98 are provided in the cylinder body by which hydraulic hoses 99—99 (FIG. 4) are connected. Fluid is pumped from a reservoir to either side of a power piston (not shown) housed within the cylinder body. The activity of each power cylinder is controlled by the operator from the cab of the vehicle using suitable hydraulic controls (not shown). By simply extending and retracting the cylinder rod 90, the entire scroll like contour of the flexible moldboard can be selectively changed to direct the discharge of snow from the plow. In addition, the shape of the moldboard can be finely adjusted or tuned to more efficiently handle snow under a wide range of conditions. Snow passing through the assembly will not adhere to the sheet so that once an adjustment is made, the flow path of the material will remain constant as long as the snow condition remains unchanged.

While this invention has been explained with reference to the structure disclosed herein, it is not confined to the details as set forth and this application is intended to cover any modifications and changes as may come within the scope of the following claims.

What is claimed is:

1. A moldboard assembly for a single discharge plow that includes, a frame means attachable to a prime mover, an elongated scraper blade unit attached to the frame means, a rectangular shaped plastic moldboard secured along its bottom edge to the scraper blade unit, means for securing one side edge of the moldboard in a fixed position to said frame means, an arcuate shaped adjusting arm connected at one end by a universal joint means to the top corner of the moldboard adjacent the other side edge thereof, bracket means movably mounted in the frame means for rotation about a vertical axis, hinge means for connecting the opposite end of the arm to the bracket means for rotation about a horizontal axis, and drive means for selectively rotating said arm about said horizontal axis to roll the moldboard into a desired scroll-like configuration to control the flow of material passing through the moldboard.

2. The moldboard assembly of claim 1 wherein said frame means comprises a main frame member.

3. The moldboard assembly of claim 1 wherein said means for securing one side edge of the moldboard in a fixed position to said frame means comprises a side frame member secured to one end of said moldboard sheet to fix said one end thereof in a predetermined curved configuration.

4. The moldboard assembly of claim 1 wherein said drive means comprises a power cylinder pivotally mounted in said bracket means and having an extendable rod arranged to act between said adjusting arm and said frame means to move said adjusting arm in a vertical plane about said hinge means as said rod is extended and retracted.

5. The moldboard assembly of claim 4 wherein said bracket means comprises a bracket for mounting said power cylinder and a vertically disposed pivot pin for securing said bracket in said frame means so that the bracket can turn about said pivot pin.

6. The moldboard assembly of claim 1 wherein said hinge means comprises a horizontally disposed hinge pin attached to said bracket means and securing the proximal end of said adjusting arm so that said adjusting arm can turn about said hinge pin.

* * * * *